33-241 SR

1/27/87 XR 4,638,565

United States Patent [19]

Podany et al.

[11] Patent Number: 4,638,565

[45] Date of Patent: Jan. 27, 1987

[54] BOW SIGHT

[76] Inventors: Clayton J. Podany, 7317 Valley St.; Richard W. Glaseman, 6103 Oak St., both of Omaha, Nebr. 68124

[21] Appl. No.: 81,452

[22] Filed: Oct. 3, 1979

[51] Int. Cl.[4] ..... F41G 1/34

[52] U.S. Cl. ..... 33/265; 33/241

[58] Field of Search ..... 33/265, 241, 242, 269; 362/110

[56] References Cited

U.S. PATENT DOCUMENTS

| | | | |
|---|---|---|---|
| 2,162,723 | 6/1939 | Karnes | 33/241 |
| 2,392,979 | 1/1946 | Douden | 33/241 UX |
| 2,909,838 | 10/1959 | Kollmorgen et al. | 33/241 |
| 3,833,799 | 9/1974 | Audet | 33/241 |
| 4,177,572 | 12/1979 | Hindes | 33/265 |
| 4,179,613 | 12/1979 | Koren | 33/265 |
| 4,220,983 | 9/1980 | Schroeder | 33/241 X |

FOREIGN PATENT DOCUMENTS

| | | | |
|---|---|---|---|
| 17861 | of 1909 | United Kingdom | 362/110 |

*Primary Examiner*—William D. Martin, Jr.
*Attorney, Agent, or Firm*—Henderson & Sturm

[57] ABSTRACT

A bow sight for attachment to an archery bow for use in combination with a sight mounted on a bow string, the bow sight utilizing a variable light source as an aiming reference which source is connected to a power pack and variable resistance, wherein the intensity of the light source can be adjusted according to the conditions facing the archer.

4 Claims, 7 Drawing Figures

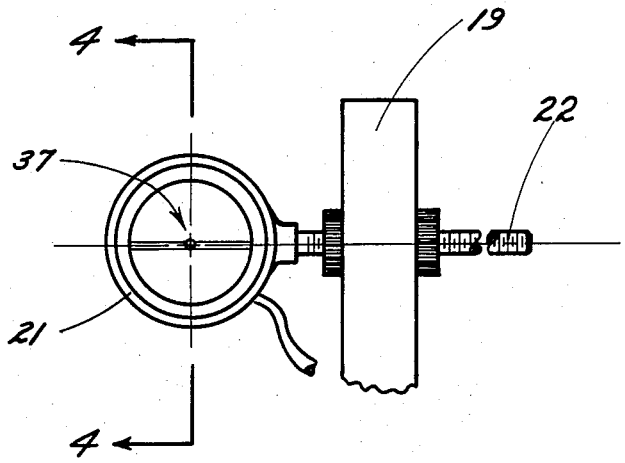
FIG. 3
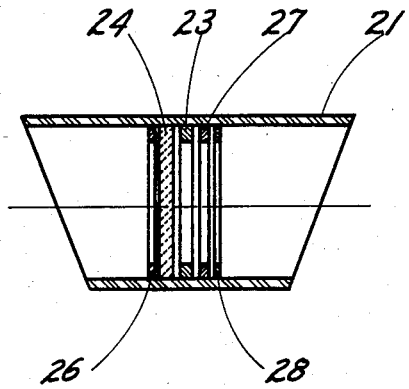
FIG. 4
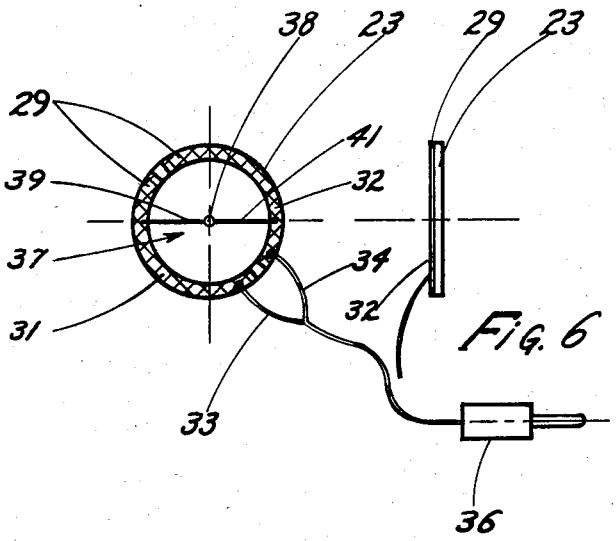
FIG. 5
FIG. 6
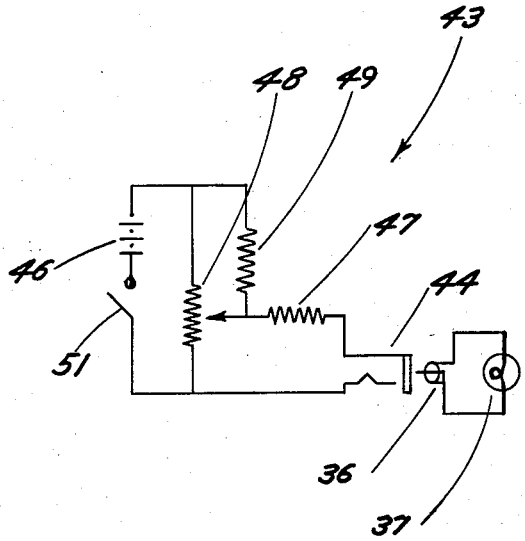
FIG 7

BOW SIGHT

BACKGROUND OF THE INVENTION

This invention relates generally to a bow sight for use by an archer and more particularly to an aiming reference within the bow sight.

The original method of aiming an arrow at a target is generally an inexact sight alignment of the arrow with the target. As the distance to the target increases, the angle of inclination of the arrow from the horizontal is increased to compensate for the effect of gravity on a flying arrow. Also wind movements from the side of the projected path of the arrow require compensation in the aiming of the arrow.

Gravity and windage corrections can be more exact under many conditions by the use of peep sights on the bow string and bow sights on the bow. The aiming reference on a bow sight can either be a pin head, a V sight, or cross hairs mounted either alone or in combination with a lens varying in power from 0 to 8 or even greater.

Problems existing with either a pin head or cross hairs aiming reference are the size and the color of the aiming reference relative to the target and the background of the target. If the size of the aiming reference is sufficiently large to make it readily observable under any kind of conditions then, at distances of under fifty yards, the archer is required to again estimate to a certain degree the aiming of the arrow. The aiming reference under that distance could easily project over an area having a radius of several inches.

Under cloudy conditions, at twilight, or when the background is shaded or blends with the target a small aiming reference may be undiscernable or barely discernable. Those adverse conditions require more time and make it more difficult to properly align the bow and arrow with the target.

SUMMARY OF THE INVENTION

In accordance with the present invention, an aiming reference for an archery sight has been devised which is a variable light source. The light source is connected to a power pack and a variable resistor wherein the intensity of the light source can be varied.

Accordingly, it is the principal object of the present invention to provide a novel and an improved aiming reference for an archery sight.

Another object of the invention is the provision of an aiming reference formed from a light source.

Yet another object of the invention is to provide an aiming reference formed from a light source having a variable intensity.

A further object of the invention is the provision of an aiming reference which is micro in size but yet readily discernable at any range.

Still a further object of this invention is to provide an aiming reference which is readily discernable under the most unfavorable light conditions and for the most unfavorable background or target conditions.

Yet a further object of the invention is the provision of an aiming reference for a bow sight which is extremely effective in use, economical of manufacture, and durable and simply of construction.

These objects and other features and advantages of the invention will become more readily apparent upon reference to the following description when taken in conjunction with the accompanying drawings.

BRIEF DESCRIPTION OF THE DRAWINGS

In the drawings as hereinafter described, a preferred embodiment of the invention is illustrated; however, various modifications can be made thereto without departing from the true spirit and scope of the invention:

FIG. 3 is a partial front elevational view of the bow sight;

FIG. 4 is a sectional view taken along the lines 4—4 in FIG. 3;

FIG. 5 is an enlarged front elevational view of the aiming reference and mounting ring;

FIG. 6 is a side elevational view thereof; and

FIG. 7 is a schematic of the electrical circuitry.

DESCRIPTION OF THE PREFERRED EMBODIMENT

Figure 1:
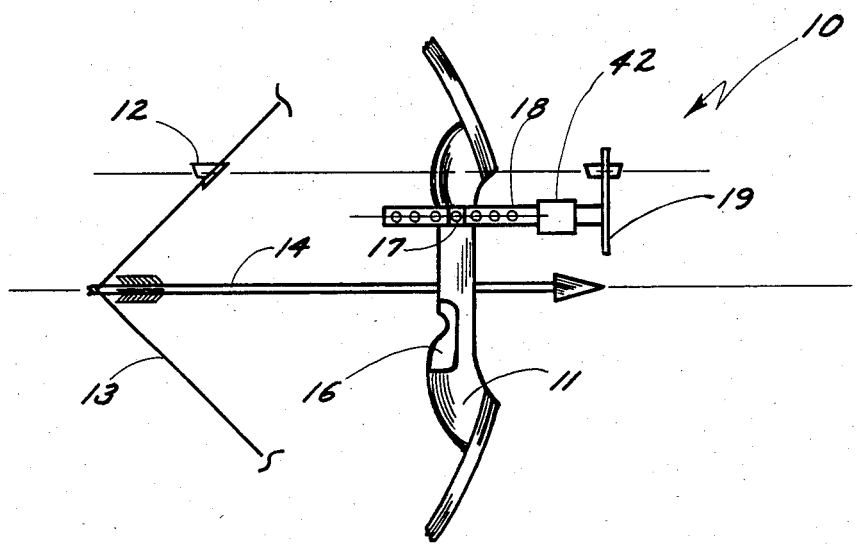
FIG. 1 is a partial elevation view of a bow and bow string with a peep sight and bow sight affixed thereto.
Figure 2:
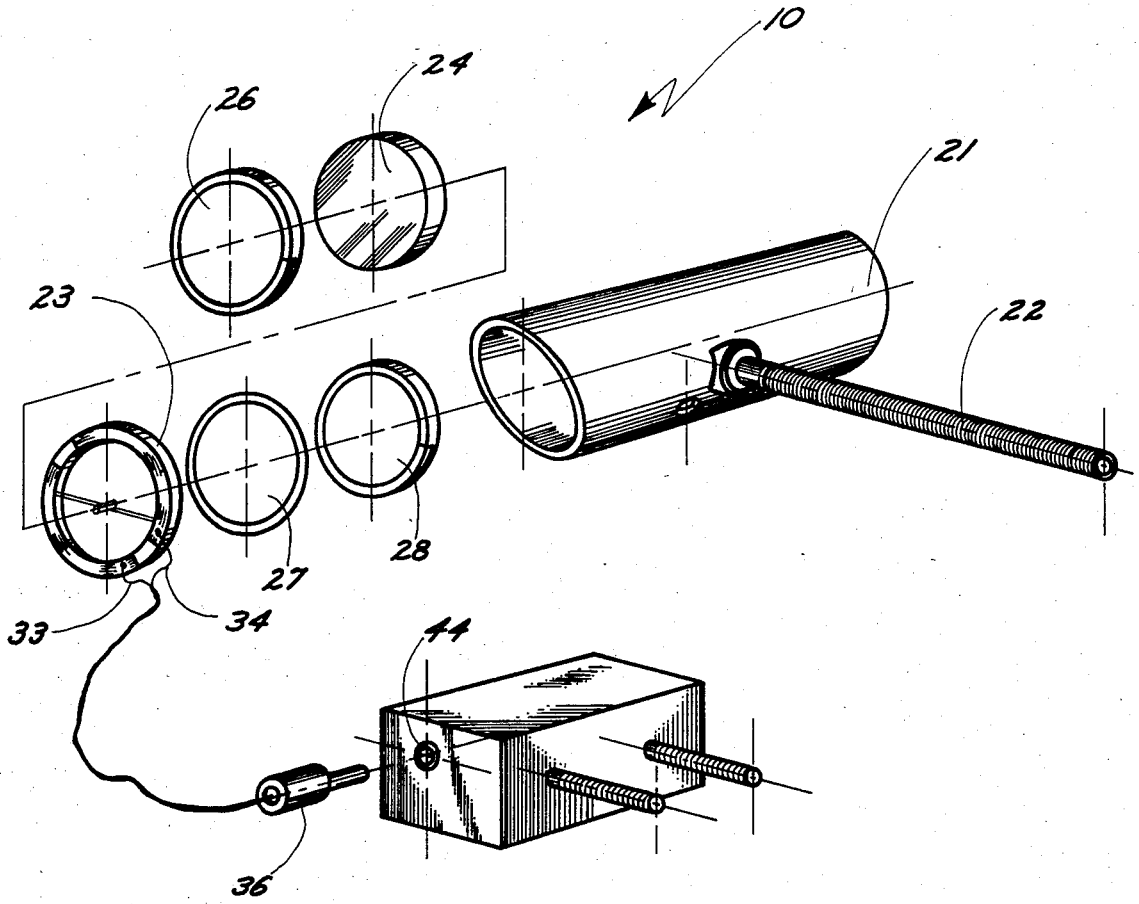
FIG. 2 is an exploded view of the bow sight.

Referring now to the drawings, the bow sight of this invention is indicated generally by the numeral 10 in FIGS. 1 and 2. The bow sight is affixed to an archer's bow 11 and is used in combination with a peep sight 12 mounted on a bow string 13. Also depicted in FIG. 1 is an arrow 14 to show the relationship of the above mentioned elements.

Secured to the bow 11, on the side opposite the arrow, above a grip 16 is a bracket 17 having a forwardly projecting arm 18. Affixed to the forward end of the arm 18 is a vertical bar 19. Adjustably mounted on the bar 19 is the bow sight 10.

The bow sight 10 (FIGS. 2 and 3) includes a tubular housing 21 having a sight passage 20 formed longitudinally therethrough. A threaded mounting shaft 22 is secured to the outer wall of the housing and projects radially therefrom. The shaft 22 is adjustably affixed to the vertical bar 19 to permit the bow sight to be raised, lowered, moved to the right, or moved to the left.

Disposed laterally in the bow sight 10 is an annular mounting ring 23 (FIGS. 2 and 4). Abutting the mounting ring 23 is a lens 24 and mounted behind the lens 24 is an annular positioning ring 26. The mounting ring 23 is held against the lens by an O-ring 27 and a split ring 28.

The mounting ring 23 (FIGS. 5 and 6) is formed from a non-conductive material and has a copper film 29 disposed on one side thereof. A portion of the copper film 29 is removd at 45° and 225° thus providing two substantially semi-circular conductive spaced bands 31 and 32. Secured as by soldering to each band is one end of a wire 33 or 34. The other ends of the wires are connected to a male plug 36.

A hole 40 (FIGS. 2 and 3) is formed in the wall of the housing 21 proximate the mounting shaft 22. The wires 33 and 34 are disposed through the hole 40 with the mounting ring 23 in the housing 21 and the male plug 36 distal the housing 21.

An aiming reference or light source 37 (FIG. 5) includes a filament 38 connected between the ends of two electrical leads 39 and 41. The leads are secured at their other ends to the bands 31 and 32 respectively and position the filament 38 at the center of the mounting ring 32.

Secured to the arm 18 (FIGS. 1 and 2) proximate the vertical bar 19 is a power pack container 42. Disposed in the container is an electric circuit 43 (FIG. 7) connected on one end to a female plug 44. The circuit 43 includes in series a 9 volt battery 46; a first resistor 47 (430); a variable resistor 48 (5000) connected in parallel with a third resistor 49 (360); a switch 51; and the light source 37 (0.014A and 214). The male plug 36 is removably mounted in the female plug 44 thus completing an electric connection between the light source 37 and the electric circuit 43.

The variable resistor 48 is operable between a first position wherein no current is supplied to the light source 37 to a fully closed position wherein the light source is at maximum intensity. In operation the intensity of the light source 37 is adjusted to provide an adequate aiming reference.

Although a circuit and light source has been illustrated in a preferred form, it will be appreciated that they may assume other configurations to accomplish the desired result of a micro-sized aiming reference formed from a light source having an intensity which is variable.

We claim:

1. A sight for use with a weapon, the sight comprising:

housing means have a passage formed longitudinally therethrough;

mounting means secured to said housing means and projecting therefrom, said mounting means adapted for affixment to the weapon;

an aiming reference disposed in said passage, said aiming reference including a light source means for producing a light, said light source means including enclosed filament means for receiving electricity therethrough spaced from the walls of said passage, said filament means having a variable intensity and said electrical means including a variable means for adjusting said intensity, said aiming reference including a mounting unit laterally disposed in said housing and having an opening formed therein with said filament means disposed in said opening;

electrical means connected to said filament means for conducting electricity to said filament means;

power means connected to said electrical means wherein said filament means is energized thus producing light; and said mounting means including a mounting ring formed from a non-conductive material, a pair of spaced copper bands affixed to said mounting means, a pair of leads, each secured on one end to one of said bands respectively with the other end of each lead secured to said filament means with said leads positioning said filament means at the center of said mounting ring.

2. A sight as defined in claim 1 and including a lens mounted laterally in said housing means proximate said mounting means.

3. A sight as defined in claim 2 and including an annular positioning ring mounted in said housing means to position said mounting means, and a split ring mounted in said housing means to hold said mounting means against said positioning ring.

4. A sight as defined in claim 1 wherein said light source means comprises an incandescent lamp spaced entirely away from the walls of said passage.

* * * * *